US005360559A

United States Patent [19]

Cooke

[11] Patent Number: 5,360,559

[45] Date of Patent: Nov. 1, 1994

[54] MODIFIED LIGNINSULFONATES AS DISPERSING AGENTS FOR BENZOLTRIAZOLE ULTRA-VIOLET ABSORBING AGENTS

[75] Inventor: Thomas W. Cooke, Greensboro, N.C.

[73] Assignee: Ciba-Geigy Corporation, Ardsley, N.Y.

[21] Appl. No.: 168,743

[22] Filed: Dec. 16, 1993

Related U.S. Application Data

[63] Continuation of Ser. No. 912,069, Jul. 8, 1992, abandoned, which is a continuation of Ser. No. 537,393, Jun. 13, 1990, abandoned, which is a continuation-in-part of Ser. No. 515,979, Apr. 27, 1990, abandoned, which is a continuation-in-part of Ser. No. 487,564, Mar. 2, 1990, abandoned.

[51] Int. Cl.[5] ..... D06M 11/00; D06M 13/00

[52] U.S. Cl. ..... 252/8.7; 8/118; 8/648; 524/91

[58] Field of Search ..... 252/8.7; 524/91; 8/118, 8/648

[56] References Cited

U.S. PATENT DOCUMENTS

| | | | |
|---|---|---|---|
| 3,004,896 | 10/1961 | Heller | 524/59 |
| 3,189,615 | 6/1961 | Heller | 548/260 |
| 4,094,634 | 6/1978 | Becker et al. | 8/648 |
| 4,141,903 | 2/1979 | Adler | 548/260 |
| 4,308,203 | 12/1981 | Lin | 8/589 |
| 4,386,037 | 5/1983 | Baumann | 260/512 |

FOREIGN PATENT DOCUMENTS

| | | |
|---|---|---|
| 354174 | 2/1990 | European Pat. Off. . |
| 3706915 | 9/1987 | Germany . |
| 2187746 | 9/1987 | United Kingdom . |
| 8802042 | 3/1988 | WIPO . |

OTHER PUBLICATIONS

Dynasperse A, Daishowa (date unknown).

The Lignin Story, Reed lignin/Daishowa (Sep. 1985).

P. Dilling & H. Eicke, Adsorption of Lignosulfonates to Disperse Dye Substrates (May 1988) 2nd World Conference.

*Primary Examiner*—Prince Willis, Jr.

*Assistant Examiner*—James M. Silbermann

*Attorney, Agent, or Firm*—George R. Dohmann

[57] ABSTRACT

Stable dispersions of benzotriazole U.V. absorbing agents utilizing modified ligninsulfonates as the dispersing agent. The modified ligninsulfonates are formaldehyde condensates of ligninsulfonate. The disclosed dispersions have improved stability at elevated temperatures and improved application characteristics.

8 Claims, No Drawings

MODIFIED LIGNINSULFONATES AS DISPERSING AGENTS FOR BENZOLTRIAZOLE ULTRA-VIOLET ABSORBING AGENTS

This application is a continuation of Ser. No. 07/912,069 filed Jul. 8, 1992 now abandoned, which is a continuation of Ser. No. 07/537,393 filed Jun. 13, 1990 now abandoned, which is a continuation in part of Ser. No. 07/515,979 filed Apr. 27, 1990 now abandoned, which is a continuation in part of Ser. No. 07/487,564 filed Mar. 2, 1990 now abandoned.

This invention relates to stable dispersions of benzotriazole ultraviolet (U.V.) absorbing agents utilizing modified ligninsulfonates as the dispersing agent, a method of dispersing the benzotriazole U.V. absorbing agents, a method of protecting textiles by utilizing the stable dispersions and textiles treated with the stable dispersions.

Benzotriazole U.V. absorbing agents are often co-applied with disperse dyes to textiles to improve light-fastness. The U.V. absorbing agent is generally applied to the textile in the form of an aqueous dispersion, together with disperse dyes, in pressurized water systems at 110°–130° C. Under these high temperature conditions, ordinary dispersing agents, such as unmodified ligninsulfonates and formaldehyde condensates of naphthalenesulfonates, desorb from the U.V. absorbing agent resulting in undispersed deposits on the textile.

This problem is particularly severe in applications where the textile is held in a fixed position with the dyebath solution being pumped through the textile. Under these conditions any undispersed U.V. absorbing agent is filtered out, producing deposits. Beam and package application methods are examples where the problem is particularly severe.

Beam dyeing involves woven or knitted fabric wrapped tightly around a cylinder with holes in it (the beam). The dye liquor is pumped through the wrapped fabric under pressure and heat.

Package dyeing is similar to beam dyeing, but involves yarn rather than fabric.

It has been discovered that formaldehyde condensates of ligninsulfonates such as described in U.S. Pat. No. 4,308,203 can impart the required high temperature stability to dispersions of benzotriazole U.V. absorbing agents. The addition of these modified ligninsulfonates greatly reduces or entirely eliminates the filtration deposits usually seen in the application of benzotriazole U.V. absorbing agents to textiles by the beam and package application methods.

In addition, the modified ligninsulfonate dispersing agents utilized by the present invention produce dispersions which exhibit little sedimentation and virtually no particle size growth (i.e. recrystallization) even after many months of storage at elevated temperatures. This increased storage stability is an additional advantage of the present invention.

The modified ligninsulfonate dispersing agents of this invention can also advantageously be used with other types of U.V. absorbing agents such as benzophenone U.V. absorbing agents.

The term textile as used in this application is meant to include various fibers, yarns and fabrics. Among the textiles to be protected are those composed of polyester and polyamide. The present invention is especially useful for improving the light-fastness of polyester automotive fabrics.

Benzotrizole U.V. absorbing agents are well-known in the art for preventing damage to textiles due to exposure to U.V. light. Benzotriazole U.V. absorbing agents are described in U.S. Pat. Nos. 3,004,896, 3,189,615, and U.S. Pat. No. 4,141,903, which are here incorporated by reference.

Preferred benzotriazole U.V. absorbing agents are 2-aryl-4,5-arylo-1,2,3-triazole compounds as described in U.S. Pat. No. 3,004,896. Especially preferred benzotriazole U.V. absorbing agents are those in which the 2-aryl group is a phenyl radical having a free hydroxyl group in the 2-position with regard to the linkage with the triazole ring. It is preferrable that the phenyl radical be further substituted in the 3 and 5 or in the 4 and 5 positions by lower alkyl and/or chlorine.

An especially useful benzotriazole U.V. absorbing agent is 2-(3'-tert-butyl-2'-hydroxy-5'-methylphenyl)-5-chloro-benzotriazole, which is commercially available as TINUVIN ® 326 from CIBA-GEIGY.

The dispersing agents utilized in this invention are formaldehyde condensates of ligninsulfonate. Preferred dispersing agents are polymers of ligninsulfonates (in their various salt forms) with formaldehyde and phenol or hydroxyl benzyl alcohols having the formula:

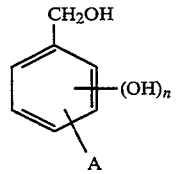

as described in U.S. Pat. No. 4,308,203. The modified ligninsulfonate dispersants of this invention can be distinguished from ordinary ligninsulfonates by their ability to keep an aqueous benzotriazole in suspension in filtration tests at 110°–130° C. in laboratory pressurized water test dyeing equipment. The Pretema laboratory dyeing machine is an example of laboratory pressurized water test equipment.

A most preferred dispersing agent is a lignosulfonic acid, sodium salt, polymer with formaldehyde and phenol, CAS Reg. No. 37207-89-9, with a sulfur content of 2–5% from the sulfonic acid groups. One such agent is available from Daishowa Chemicals Inc. under the name Dynasperse-A.

Although this phenol-formaldehyde modified ligninsulfonate is known in the preparation of disperse dyes, its use for producing stable dispersions of benzotriazole U.V. absorbing agents has not previously been reported.

The compositions of this application are aqueous dispersions comprising from about 10 to 60 percent by weight of benzotriazole U.V. absorbing agent and from about 3 to 24 percent by weight of modified ligninsulfonate dispersing agent. Preferrably the compositions will contain about 25 to 35 percent by weight of the benzotriazole U.V. absorbing agent and about 9 to 13 percent by weight of modified ligninsulfonate.

Generally, the ratio of benzotriazole U.V. absorbing agent to modified ligninsulfonate dispersing agent will be in the range of about 2:1 to 4:1; preferrably 2.5:1 to 3.0:1.

In addition to the benzotriazole U.V. absorbing agent and modified ligninsulfonate dispersing agent, the compositions of this application can contain typically used dyebath auxiliaries such as biocides, preservatives, freeze-thaw stabilizers (e.g. glycols), thickeners, wetting agents, defoamers and buffers.

The dispersions of this invention can be prepared by dissolving the modified ligninsulfonate dispersant in water together with any dyebath auxiliaries. The benzotriazole U.V. absorbing agent, as an insoluble powder, is added slowly with vigorous agitation to form a wetted-out slurry. This slurry is then ground, for example, in a sand-mill or a ball-mill, until the average particle size is about 1.5 microns or less. The dispersion formed is a free-flowing, opaque liquid which dilutes readily in water with gentle stirring.

The pH of the dispersion is generally adjusted to be in the range of 4–9.

In addition to the already-mentioned beam and package dyeing application, the dispersions of this invention can be utilized in dyeing applications wherein the dyebath liquor is stationary and the fabric is in motion. Jet and continuous dyeing machines are examples of this type of application. The dispersions may also be spray applied.

This invention is illustrated by, but not limited to, the following examples.

EXAMPLE 1

| | A | B |
|---|---|---|
| Ingredients: | | |
| Water | 66.0% | 55.85% |
| Tinuvin 326 ® (CAS No. 386-11-5) | 25.00% | 25.00% |
| Dynasperse-A (CAS No. 37207-89-9) | 9.00% | 9.00% |
| Propylene glycol | — | 10.00% |
| Preservative/biocide | — | 0.15% |
| Method of Preparation: | 300 g batch, continuous grinding (20 hours) in laboratory sand-mill with 20–30 mesh sand. | 4000 g batch, 17 passes thru Dyno-mill pilot sand-mill with 1 mm glass beads. |
| Storage Stability: | | |
| Initial Particle Size - 50% value (by Granulometre) | <0.6 microns | <0.6 microns |
| Aged at 40° C. for 3 months: | | |
| Liquid (serum) separation | 5% | 10% |
| Solid sedimentation | 0% | 0% |
| Aged at 60° C. for 3 months: | | |
| Liquid (serum) separation | 5% | 15% |
| Solid sedimentation | 0% | 0% |
| Particle size | <0.6 microns | <0.6 microns |
| Performance*: | | |
| 1.2 g of Tinuvin 326 dispersions at 25% actives, for 0.3 g actives on 30 g PES fabric (for 1% Tinuvin 326 actives on weight of fabric) in 300 g total dyebath solution (10 to 1 liquor ratio) | | |
| Heat to 110° C., hold 30 min., cool to 80° C. | good, no deposits | good, no deposits |
| Heat to 120° C., hold 30 min., cool to 80° C. | good, no deposits | good, no deposits |
| Heat to 130° C., hold 30 min., | good, no deposits | good, no deposits |

*Filtration deposit test in "Pretema" laboratory beam dyeing machine on 30 g fabric samples (pre-dyed black polyester) with typically used dye-bath auxiliaries (0.4% o.w.f. of a sodium napthalene sulfonic acid condensate dispersing agent and 1% o.w.f. of an ethoxylated fatty acid leveling agent).

For comparison, a similar Tinuvin ® 326 dispersion made with an ordinary, unmodified, lignin-sulfonate dispersant (i.e., ammonium-lignosulfonate, CAS No. 8061-53-8) showed severe filtration deposits on the fabric in the Pretema machine test, under the same conditions, especially at 110° and 120° C.

EXAMPLE 2

Formulations (C) and (D) with the following compositions are prepared and utilized in Examples (3)–(6). Formulation (D) is a control prepared with unmodified lignin-sulfonate dispersant.

| Ingredients (grams/liter) | C | D |
|---|---|---|
| Tinuvin 326 ® | 25.0 | 33.0 |
| Propylene glycol | 10.0 | — |
| Ethylene glycol | — | 10.0 |
| Dynasperse-A (CAS No. 37207-89-9) | 9.0 | — |
| Ammonium lignosulfonate (CAS No. 8061-53-8) an unmodified lignosulfonate | — | 12.0 |
| Proxel ® CRL[1] | 0.15 | 0.15 |
| Water | Rest | Rest |

[1]Preservative, 1,2-benzoisothiazolin-3-one (CAS No. 2634-33-5) from ICI.

EXAMPLE 3

The formulations of Example 2 are tested for particle size and recrystallization with the following results*: Mean value of particle sized measured on Granulometer.

| | C | D |
|---|---|---|
| Particle size (initial) | <1 um | <1 um |
| Particle size (aged) | | |
| 3 months at 25° C. | <1 um | <1 um |
| 3 months at 40° C. | <1 um | 1–2 um |
| 1 month at 60° C. | <1 um | 1–2 um |

EXAMPLE 4

Filter Test (2/4 filter paper configuration in AATCC method 146–1989)

| | C | D |
|---|---|---|
| 3 months at 25° C. | OK | OK |
| 3 months at 40° C. | OK | OK |
| 1 month at 60° C. | OK | Fails |

EXAMPLES 5–7

The performance of the formulations of Example 2 was tested in beam or package application methods in Examples 5–7.

In each of Examples 5–7, a dyebath solution was prepared by adding the indicated dyes and the U.V. absorber dispersion into a dyebath containing the described dye system (auxiliaries). All percentages are based on the weight of fiber.

The U.V. absorber dispersions of Example 2 are added to the dyebath in the amount necessary to prepare a dyebath containing 1% TINUVIN® 326 based on the weight of fiber. This is equivalent to 4% of formulation (C) or 3.0% of formulation (D).

EXAMPLE 5

Package Machine

| | |
|---|---|
| Machine: | Callibaut de blicqui, capacity 150 liters |
| Substrate: | PES-DACRON yarn, 6 packages, total weight 9.917 kg |
| Dye System: | 5.0 g/l Transferin N-40 (dispersing agent from Boehme-Filatex)<br>5.0 g/l VP 4405 (leveling agent from Boehme-Filatex)<br>2.5 g/l acetic acid (20%) |
| Liquor ratio: | 1:15 |
| Dyes: | 1.7689% Terasil Yellow GWL<br>1.5300% Palanil Red FFN-Y<br>0.7420% Palanil Pink REL 200%<br>0.4051% Terasil Blue E-LF 27<br>0.1002% Poly. Blue FS 200% |
| Dye-cycle: | Program AUTO : load chemicals at 70° C.<br>heat to 133° C. within 30 min.<br>(3 holding times 6 min. each at 95, 105, 112° C.)<br>dye 30 minutes at 133° C.<br>drop hot at 133° C. |
| Scour: | 1.75 g/l caustic (50%)<br>1.75 g/l Virtex D (reducing agent from Hoechst). |

The packages were broken and knitted to socks with yarn from inside, middle and outside to check for depositions and levelness of the dyeing.

| RESULTS: | C | D |
|---|---|---|
| Deposits | No | Yes |
| Levelling | Poor | Poor |

EXAMPLE 6

Beam Machine (pilot)

| | |
|---|---|
| Machine: | Bentley-Pegg beam machine, capacity 208 liters plus expansion tank |
| Substrate: | BASF-DACRON fabric, total weight 19.50–20.00 kg |
| Pre-scour: | Not applied |

-continued

| | |
|---|---|
| Dye System: | 0.4% Irgasol DA powder (dispersing agent from CIBA-GEIGY)<br>1.0% Tinegal NT (leveling agent from CIBA-GEIGY<br>1.0% acetic acid (28%) |
| Liquor ratio: | Approximately 1:10 |
| Dyes: | 0.34% Terasil Yellow GWL new<br>0.26% Terasil Brilliant Pink 3G<br>0.719% Terasil Blue E-GLF<br>0.037% Terasil Blue BGE |
| Dye-cycle: | Load chemicals at 120° F. (50° C.) and run for 10 minutes;<br>Load dyes at 120° F. (50° C.) and run for 5 minutes<br>Heat to 265° F. (100° C.) at 3° F./min.<br>Dye at 265° F. for 45 minutes, inside-out<br>Cool to 200° F. at 5° F./min., then to 160° F. at 5° F./min.<br>Drop bath and apply overflow wash |
| Afterscour: | Only for middle of beam after samples were taken from top and botom<br>0.5% DuPonol RA[1]<br>1.0% Aerosol A-196[2]<br>2.0% caustic (50%)<br>3.0% sodium hydrosulfite<br>in jet machine, all fabrics sewed together |
| Drying: | At 250° F. on Famatex frame. |

[1]Sodium ether-alcohol sulfate from DuPont
[2]Dialkyl ester of sodium sulfosuccinate from American Cyanamid Before afterscouring, samples were taken from the top and bottom of the beam to check for depositions.

| RESULTS: | C | D |
|---|---|---|
| Deposits | Few | Many |

EXAMPLE 7

Beam Machine

| | |
|---|---|
| Machine: | Bentley-Pegg beam machine, capacity approximately 1200 liters |
| Substrate: | On the bottom: Guilford fabric - Polyester<br>On top of it: BASF-PES-DACRON, total weight 75 kg. |
| Pre-scour: | 1.0 g/l soda ash<br>2.0 g/l Ritescour TE[1]<br>2.0 g/l Tanapon INF[2] at 200° F. for 30 minutes, drop and overflow wash. |
| Dye System: | 0.4% Irgasol DA powder<br>1.75% Tinegal NT<br>2.8% acetic acid (28%) to reach pH = 4.5 |
| Liquor ratio: | Approximately 1:15, beam was only filled to half its capacity to run trials with two different materials. |
| Dyes: | 0.252% Terasil Yellow GWL new<br>0.137% Terasil Pink 2 GLA<br>0.146% Terasil Blue BFL |
| Dye-cycle: | Load chemicals at 120° F. (50° C.) and run for 10 minutes<br>Load dyes at 120° F. (50° C.) and run for 5 minutes<br>Heat to 265° F. (130° C.) at 3° F./min.<br>Dye at 265° F. for 45 minutes, inside-out<br>Cool to 200° F. at 2° F./min., then to 160° F. at 3° F./min.<br>Rinse 10 minutes at 100° F. (38° C.) |
| Afterscour: | As in Example 6, 15 minutes at 160° F. (71° C.) |
| Drying | At 250° F. on Famatex frame. |

[1]Wetting agent from Rite Color and Chemical
[2]Wetting agent from Sybron Chemicals The amount of deposits on the non-woven polypropylene liner (Typar material) that covers the very inside of the beam and the first layers of fabric are evaluated for deposits.

RESULTS

Formulation (C)

Some deposits on Typar liner.

Some minor white spots on first layer of wrapped fabric.

Formulation (D)

No deposits on Typar liner.

Heavy deposits on beams outside edges and on sides of wrapped roll of fabric.

We claim:

1. An aqueous dispersion for the treatment of textiles comprising:

(a) from about 10 to 60 percent by weight of a benzotriazole U.V. absorbing agent, wherein said U.V. absorbing agent is a water-insoluble 2-aryl-4,5-benzo-1,2,3-triazole wherein the 2-aryl group is a phenyl radical having a free hydroxyl group in the 2-position relative to the linkage with the triazole ring, and (b) from about 3 to 24 percent by weight of a formaldehyde condensate of ligninsulfonate, the ratio of (a) to (b) being from about 2:1 to 4:1.

2. An aqueous dispersion of claim 1 wherein said formaldehyde condensate of ligninsulfonate is lignosulfonic acid, sodium salt, polymer with formaldehyde and phenol.

3. An aqueous dispersion of claim 1 wherein said benzotriazole U.V. absorbing agent is 2-(3'-tert-butyl-2'-hydroxy-5'-methylphenyl)-5-chloro-benzotriazole.

4. An aqueous dispersion of claim 3 wherein said formaldehyde condensate of ligninsulfonate is lignosulfonic acid, sodium salt, polymer with formaldehyde and phenol.

5. An aqueous dispersion of claim 1 which comprises from about 25 to 35 percent by weight of component (a) and from about 9 to 13 percent by weight of component (b).

6. An aqueous dispersion of claim 1 wherein the ratio of (a) to (b) is from about 2.5:1 to 3.0:1.

7. An aqueous dispersion of claim 1 wherein said formaldehyde condensate of lignin sulfonate is the condensate of a ligninsulfonate with formaldehyde and phenol or with formaldehyde and a hydroxy benzyl alcohol of the formula

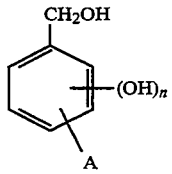

wherein n is 1, 2 or 3 and A is selected from the group consisting of hydrogen, $C_1$–$C_4$-alkyl and hydroxymethyl.

8. An aqueous dispersion of claim 1 wherein said formaldehyde condensate of lignin sulfonate is the condensate of a ligninsulfonate with formaldehyde and phenol.

* * * * *